US009414993B2

(12) United States Patent
Flynn

(10) Patent No.: US 9,414,993 B2
(45) Date of Patent: Aug. 16, 2016

(54) SEALABLE PILL ORGANIZER AND DISPENSER

(71) Applicant: Michael Flynn, Newport Beach, CA (US)

(72) Inventor: Michael Flynn, Newport Beach, CA (US)

( * ) Notice: Subject to any disclaimer, the term of this patent is extended or adjusted under 35 U.S.C. 154(b) by 97 days.

(21) Appl. No.: 14/564,942

(22) Filed: Dec. 9, 2014

(65) Prior Publication Data

US 2016/0158106 A1 Jun. 9, 2016

(51) Int. Cl.

| | |
|---|---|
| ***B65D 85/00*** | (2006.01) |
| ***A61J 7/00*** | (2006.01) |
| ***B65B 7/16*** | (2006.01) |
| ***B65D 1/36*** | (2006.01) |
| ***B65D 25/02*** | (2006.01) |
| ***B65D 65/14*** | (2006.01) |

(52) U.S. Cl.
CPC ..... *A61J 7/0069* (2013.01); *B65B 7/16* (2013.01); *B65D 1/36* (2013.01); *B65D 25/02* (2013.01); *B65D 65/14* (2013.01)

(58) Field of Classification Search
USPC ..... 206/528, 531, 532, 534, 534.1, 535, 206/536, 538; 53/473, 477, 478, 453, 485
See application file for complete search history.

(56) References Cited

U.S. PATENT DOCUMENTS

| | | | | |
|---|---|---|---|---|
| 8,757,381 | B2 * | 6/2014 | Bouthiette | B65D 1/34 206/528 |
| 2006/0118452 | A1 * | 6/2006 | Gattefosse | B65D 83/0463 206/531 |
| 2010/0264054 | A1 * | 10/2010 | Beecroft | B65D 83/0472 206/531 |
| 2010/0300923 | A1 * | 12/2010 | Sack | A61J 1/035 206/531 |
| 2011/0108451 | A1 * | 5/2011 | Sack | B65D 83/0463 206/531 |

* cited by examiner

*Primary Examiner* — Jacob K Ackun
(74) *Attorney, Agent, or Firm* — Ali Shalchi, Esq.

(57) ABSTRACT

A device is provided for storing, organizing, and dispensing prescription pills that comprises a clamshell container configured to house a sealable pill tray and sliding card. The pill tray contains an array of pill chambers that are covered by an adhesive seal composed of foil or paper. The clamshell container comprises a top portion and a bottom portion, the top portion having an array of pill holes that correspond with the chambers of the pill tray. The top of the sliding card has markings corresponding to the pill chambers beneath it and slides over the pill tray and beneath the top portion of the clam shell. Pills are placed within the pill holes on top of the sliding card. When the sliding card is removed, the pills fall through the pill holes and into the pill chambers of the pill tray.

14 Claims, 6 Drawing Sheets

SEALABLE PILL ORGANIZER AND DISPENSER

RELATED U.S. APPLICATION DATA

This application claims priority to Provisional application No. 61/625,310, filed Apr. 17, 2012 and is a continuation of non-provisional application Ser. No. 13/864,989.

FIELD OF THE INVENTION

The present invention relates to containers for storing and organizing pills.

BACKGROUND OF THE INVENTION

With today's aging population and increased usage of prescription drugs, there is a need for a simple means of storing and organizing prescription pills in a secure and convenient manner. With the prevalence of prescription drug usage, it is common for many individuals to take many pills on a daily basis. For example, if an individual is taking ten different pills a day, they then face a burden in opening and closing ten bottles every day. Some individuals often forget to take some of their daily pills, or forget whether they have taken the day's pills altogether. Also, it is desirable to store prescription pills in a manner that is secure from unwanted access by children, minors, or other individuals (e.g. hotel maids or house guests). This is particularly important because ingestion of prescription medicines by children or minors can result in illness or death. Storage of prescription pills in their native bottles does not deter unwanted access and usage because pills can be removed without detection. Given the large and varying quantity of pills within a prescription bottle, an owner cannot practically keep track of how many pills remain in a particular bottle, and will not notice if one or even several pills are removed. Thus there is a need for a device that stores and organizes prescription pills in a secure manner that deters tampering.

SUMMARY OF THE INVENTION

A device is provided for storing, organizing, and dispensing prescription pills. The device comprises a clamshell container that houses a sealable pill tray and a sliding card. The pill tray includes an array of pill chambers that may be collectively sealed by the application of an adhesive foil or paper sheet to the top surface of the tray. The clamshell container comprises a top portion and a bottom portion that are connected via a hinged joint, the top portion having an array of pill holes that correspond with the chambers of the pill tray. The top of the sliding card has markings corresponding to the pill chambers beneath it and slides over the pill tray and beneath the top portion of the claim shell. Pills are placed within the pill holes on top of the sliding card. When the sliding card is removed, the pills fall through the pill holes and into the pill chambers of the pill tray. The foil or paper seal can then be adhered to the pill tray to secure the contents of the chambers and prevent the pills from falling, as well as preventing unwanted contaminants or fluids from entering the pill chambers. The pill tray seal also acts to deter tampering and unwanted access to the pills. The adhesive foil or paper contains marks corresponding to the pill chambers (e.g. schedules, numeric counts, days, times, etc.).

DETAILED DESCRIPTION

In the following discussion, numerous specific details are set forth to provide a thorough understanding of the present invention. However, those skilled in the art will appreciate that the present invention may be practiced without such specific details. In other instances, well-known elements, processes or techniques have been briefly mentioned and not elaborated on in order not to obscure the present invention in unnecessary detail and description. Moreover, specific details and the like may have been omitted inasmuch as such details are not deemed necessary to obtain a complete understanding of the invention, and are considered to be within the understanding of persons having ordinary skill in the relevant art.

Figure 1:
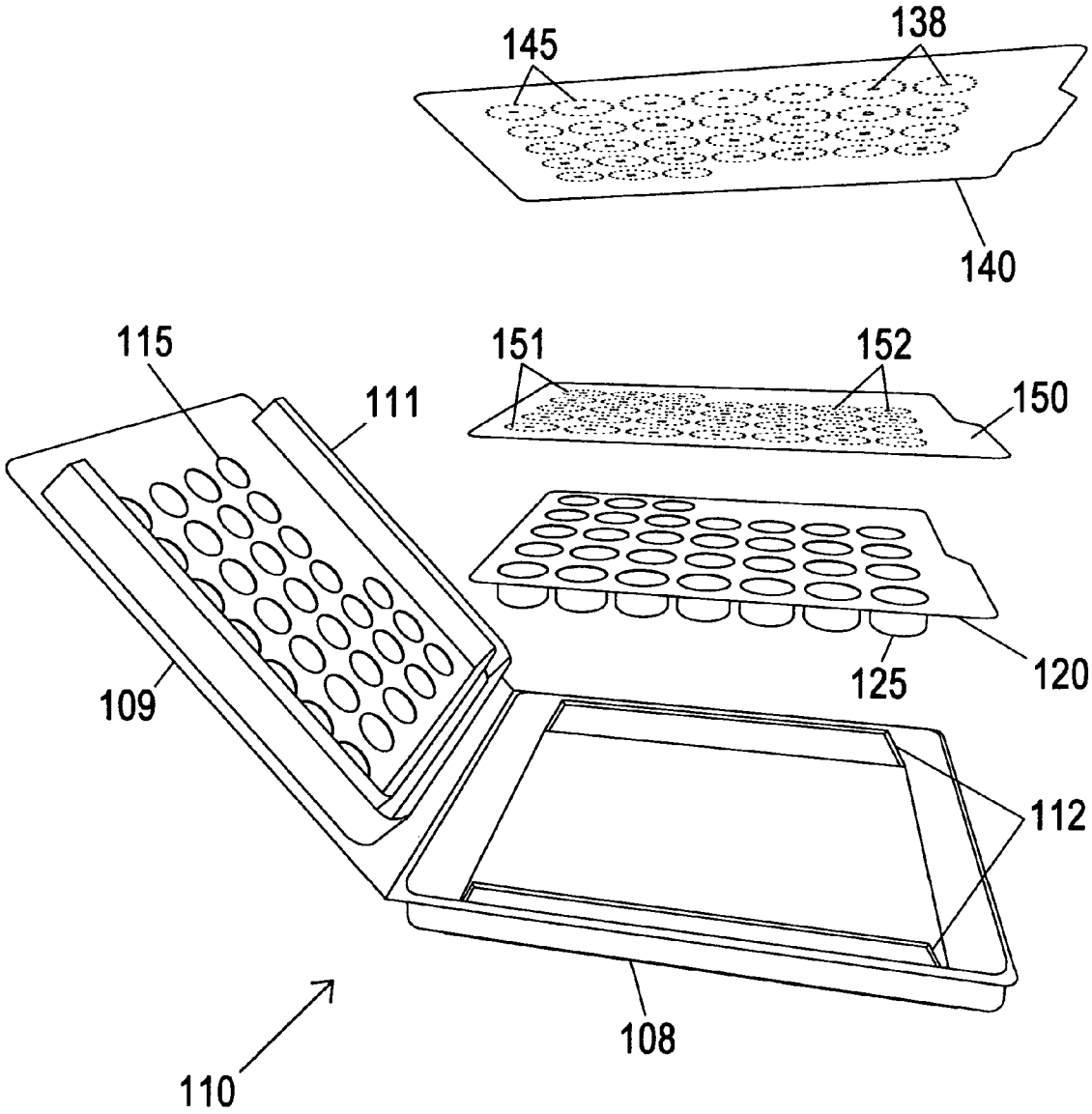
FIG. 1 illustrates an exploded view of the present invention that includes a clamshell container, pill tray, pill tray seal, and sliding card.

Referring to FIG. 1, the device of the present invention includes four discrete parts: clamshell container 110, pill tray 120, pill tray seal 150, and sliding card 140. As shown in FIG. 1, the clamshell 110 is open. Clamshell container 110 further comprises a bottom portion 108, a top portion 109, a female lining 111, linear protrusions 112, and pill holes 115. The bottom portion 108 and top portion 109 of the clamshell are connected by a hinged joint. The top portion 109 of the clamshell has an array of pill holes 115 that correspond with pill chambers 125 of the pill tray 120. The female lining 111 is configured to cover and receive the protrusions 112 when the clamshell 110 is closed. The pill chambers 125 found on the pill tray 120 are open wells extending below the bottom surface of the planar portion of the tray. Pills placed into the chambers 125 may be securely contained within by applying the pill tray seal 150 to the top surface of the pill tray 120. This adhesive foil or paper seal is marked with circled portions 151 and secondary seal markings 152 (e.g. sequential numbering from 1 through 31) which correspond to the pill chambers 125. It provides complete coverage of the top surface of the pill tray 120. This allows the pill chambers to be securely sealed to prevent contamination or loss of pills from the pill chambers. This user-applied seal remains intact until access to an individual pill chamber 125 is forcibly achieved by breaking the foil or paper area of the circled portion 151 corresponding to that pill chamber.

The material employed for the pill tray 120 can affect the manner of its use. For example, if the pill tray 120 is composed of a rigid (i.e. non-disposable) material such as a rigid polymer then it can be reused by applying and removing successive pill tray seals 150 to the pill tray. Naturally, the advantage of a non-disposable pill tray is that it can be reused by reapplying pill tray seals 150, thus eliminating the need for replacement pill trays. Alternatively, if pill tray 120 is composed of a low-cost, thin, and pliable material (e.g. plastic/polymer) then it can be disposable and thus discarded and replaced after use. When the pill tray is composed of disposable material it is deformable and the pills can be ejected from the pill chamber by pressing on the pill chambers to cause the pills inside to rupture the seal and emerge from the pill chamber. This provides for an ease of use. Further, when the pill tray is disposable, it becomes more mobile and can be used separate from the clamshell container 110. Moreover, two pill trays could be utilized by combining these two embodiments, i.e. a rigid pill tray and a disposable pill tray, wherein the disposable pill tray sits in, and is received by, the rigid pill tray. This configuration would be advantageous where the disposable pill tray is made to be very thin and lacking in structural support or rigidity, which would be provided by the rigid pill tray, whereby the disposable pill tray would rest in the rigid pill tray for support and could be removed after sealing the pills therein. Thus, the type of material used for pill tray 120 can provide versatility of use.

The top of the sliding card 140 has card markings 145 that outline and correspond to the pill chambers beneath it. Secondary card markings 138 designate the pill chambers (e.g. sequential numbering from 1 through 31). The clamshell container is preferably made of a durable polymeric material while the pill tray, pill tray seal, and sliding card are more suitably made of disposable materials. The sliding card 140 slides over the pill tray, and the linear protrusions 112, and beneath the top portion of the clam shell. Pills are placed within the pill holes on top of the sliding card 140 to allocate them to the corresponding pill chambers. Once allocation is complete, the sliding card 140 is removed, and the pills fall through the pill holes 115 and into the pill chambers 125 of the pill tray 120. This process can be repeated to add additional pills to the pill chambers. The pill chambers 125 are preferably made of thin, deformable material such as plastic (or other polymeric material) so that the pills can be more easily removed from the pill chambers by pushing the pill chamber upward to push the pills upward and out of the pill chamber—piercing the foil or paper seal above the pill chamber. The pierced area of the seal would lie within the circled portion 151 corresponding to that particular pill chamber 125. Alternatively, the pill tray and pill chambers can be made of a durable, rigid material (e.g. durable polymeric material). While an exemplary number of pill chambers are shown, other quantities and array configuration can be utilized in accordance with the present invention.

Figure 2A:
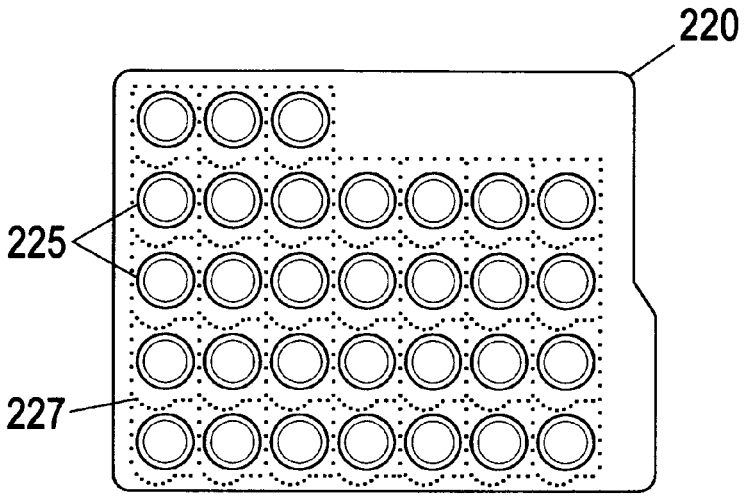
FIG. 2*a* illustrates a top view of the pill tray.
Figure 2B:
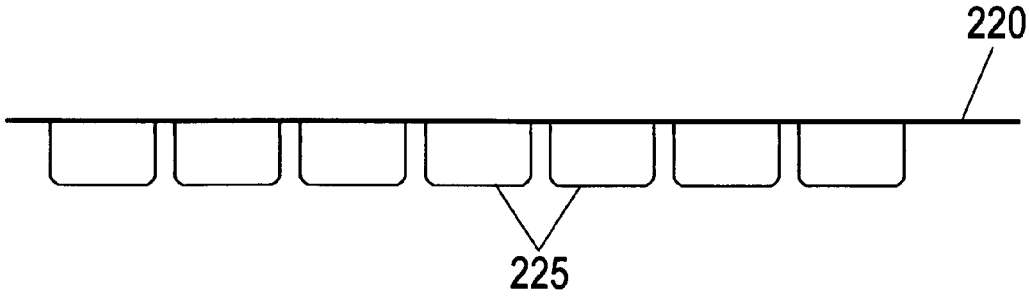
FIG. 2*b* illustrates a side view of the pill tray.

FIG. 2*a* illustrates a top view of the pill tray, including the pill chambers 225 and perforations 227. FIG. 2*b* is a side view of the pill tray 220 that shows the profile of the pill chambers (i.e. depth and width). Each pill chamber 225 extends below the bottom surface of the planar portion of the tray; the result is an array of sealable wells ideal for pill storage. In an exemplary embodiment, the pill chambers are one inch in width and 0.5 inch in depth. The perforations 227 allow the user to separate the pill tray into separate sections as desired.

Figure 3A:
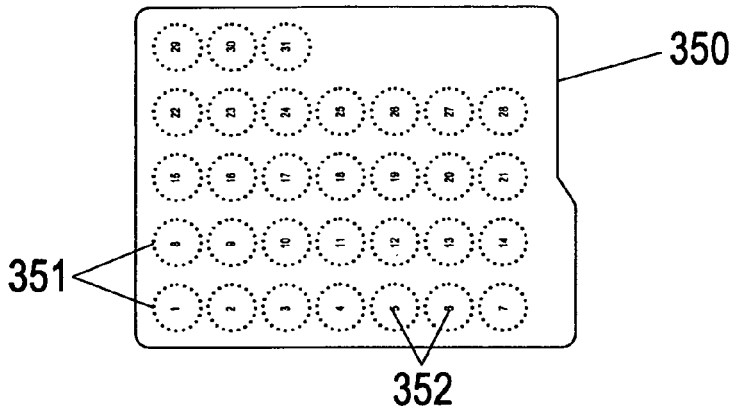
FIG. 3*a* illustrates a top view of the pill tray seal.
Figure 3B:
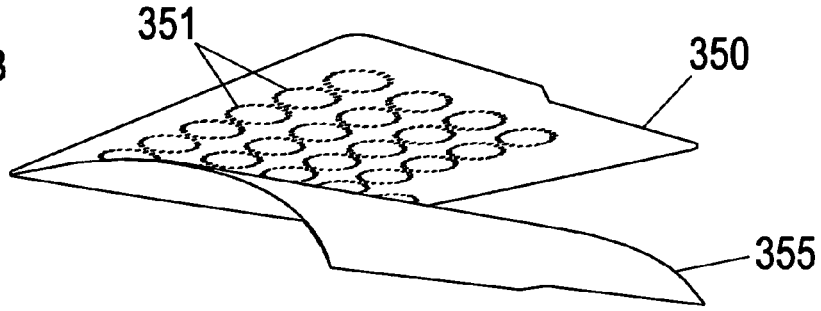
FIG. 3*b* illustrates a perspective view of the pill tray seal and its application to the pill tray via adhesion.
Figure 3C:
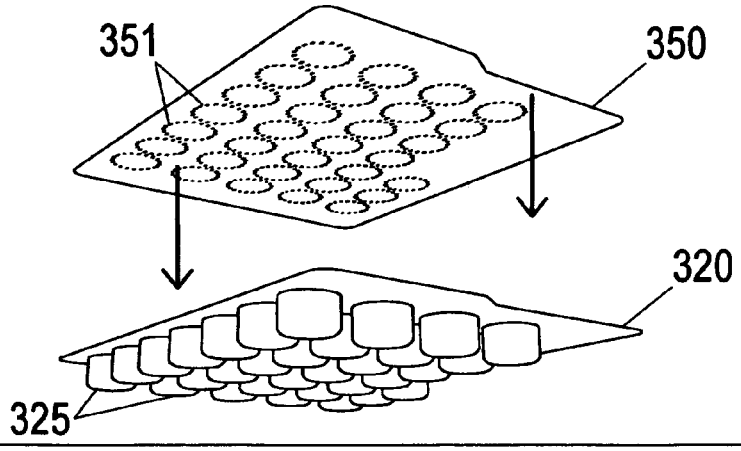
FIG. 3*c* illustrates a top view and perspective views of the pill tray seal and its application to the pill tray via adhesion.

FIGS. 3*a-c* illustrate a top view and perspective views of the pill tray seal and its application to the pill tray via adhesion. FIG. 3*a* shows a top view of the pill tray seal 350 having an array of circled portions 351 that correspond to the pill chambers 325 (shown in FIG. 3*c*). The circled portions 351 are made more discrete by secondary seal markings 352. Found in the centers of the circled portions, these secondary markings are numbered sequentially (e.g. 1 through 31 to correspond to calendar days) but other designations could be used to provide the desired organization. The seal is preferably comprised of a foil sheet (e.g. push-through foil), however a suitable paper material could also be employed. FIG. 3*b* shows the bottom of the pill tray seal 350, which has a paper backing 355 that is peeled off from the pill tray seal 350 to expose an adhesive surface. The areas within the circled portions 351 of the pill tray seal 350 are not coated with adhesive so that the pills do not stick to, or come into contact with, the adhesive. FIG. 3*c* shows the application of the pill tray seal 350 to the top surface of the pill tray 320, which seals the pill chambers 325. The foil seal is applied to the pill tray by the user as shown in FIG. 3 to create an array of encapsulated pill chambers (i.e. encapsulates). The foil seal is printed with markings that indicate, for example, calendar days, numbers, days or times. When the user wants to access the contents of a pill chamber, the user can punch into the foil seal with their finger. In the case of a deformable pill chamber, the user can also push the pills out of the pill chamber and through the seal by pressing the bottom of the pill chamber upwards. As set forth above, the pill tray and pill chambers may be composed of deformable or rigid polymeric material. The foil seal can also include perforations around the perimeter of the pill chambers to allow the foil to be punched out with more ease. This embodiment also allows the user to customize and create their own sealed array of pill chambers.

Figure 4:
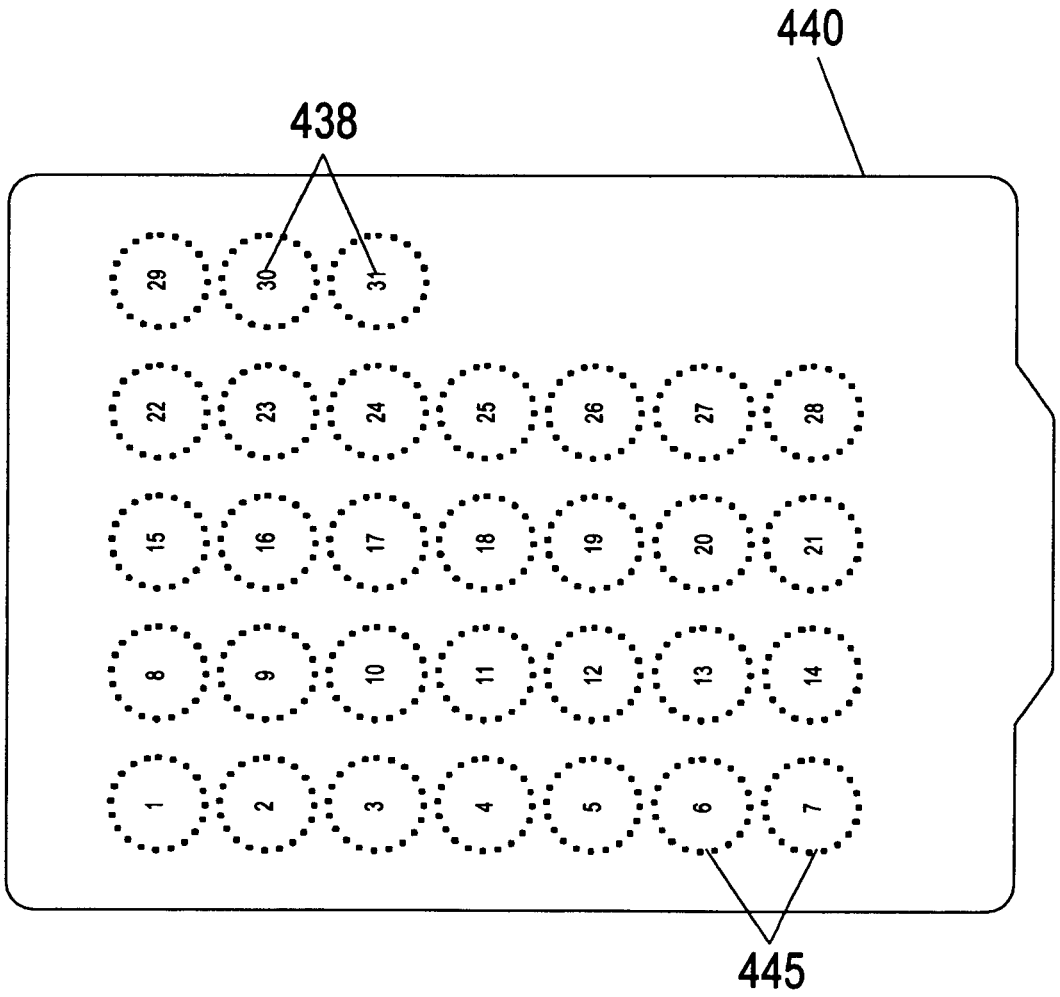
FIG. 4 illustrates a top view of the sliding card.

FIG. 4 illustrates a top view of the sliding card 440. Card markings 445 are circular indicators that outline and correspond to the pill chambers (i.e. chambers 125 of FIG. 1) found on the pill tray beneath the sliding card—once it is inserted into the clam shell. Secondary card markings 438 are labels for the pill chambers that allow the user to consume the pill in an organized, accountable manner. The markings 438 also deter unauthorized usage of pills because they can be easily accounted for by the markings. The sliding card 440 slides between the pill tray and the top portion of the clamshell (i.e. above the pill tray and below the clamshell). The user allocates the pills within the pill holes of the clamshell (i.e., holes 115 of FIG. 1) on the surface of the sliding card.

Figure 5A:
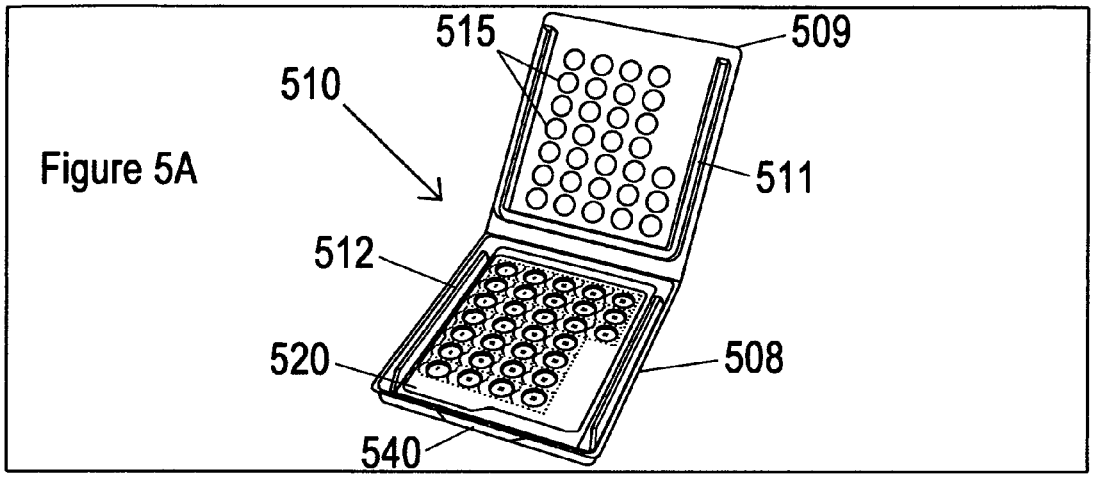
FIG. 5*a* illustrates a perspective view and a side view of the clamshell container and pill tray assembly.
Figure 5B:
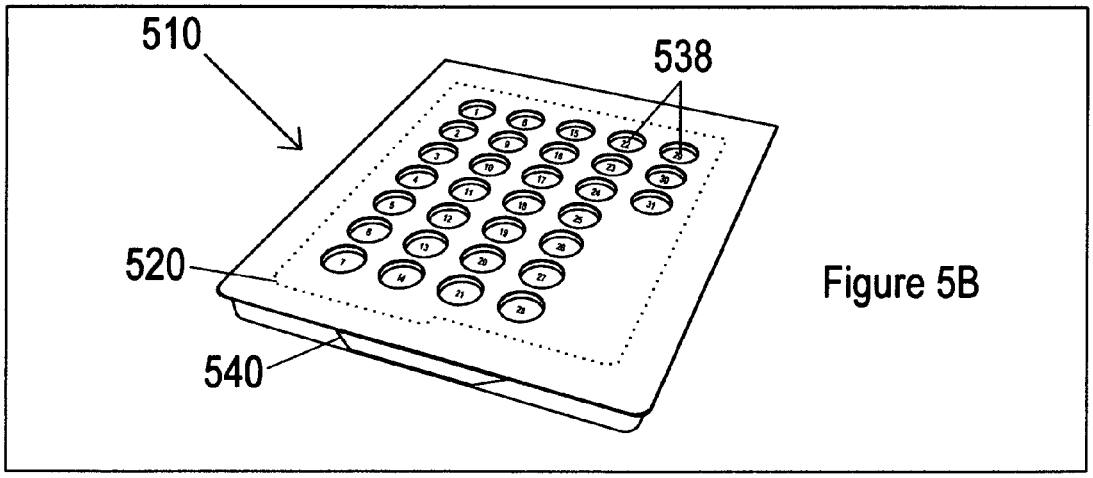
FIG. 5*b* illustrates a perspective view and a side view of the clamshell container and pill tray assembly.
Figure 5C:
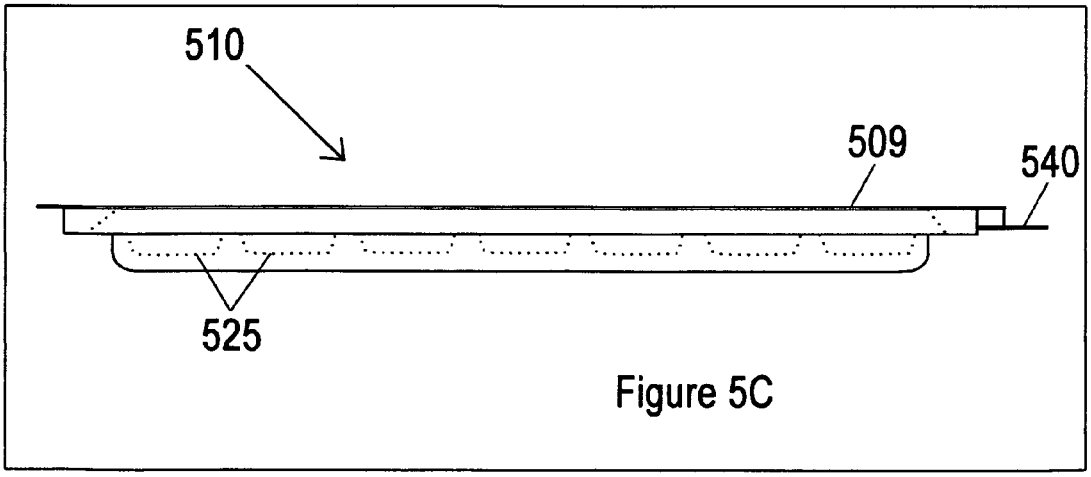
FIG. 5*c* illustrates perspective views and a side view of the clamshell container and pill tray assembly.

FIGS. 5*a-c* illustrate perspective views and a side view of the clamshell container and pill tray assembly. FIG. 5*a* shows the opened clamshell container 510 which houses pill tray 520 and sliding card 540. FIG. 5*b* shows the closed clamshell 510 in perspective and FIG. 5*c* shows a side view of the closed clamshell 510. The dotted lines 520 outline the pill tray housed within the clamshell. Dotted lines 525 show the profile of the pill chambers of the pill tray 520. The clam shell container comprises top portion 509 and bottom portion 508. The top portion 509 includes an array of pill holes 515 which, when the clamshell is closed as shown in FIGS. 5*b* & 5*c*, align with the pill chambers 525 of pill tray 520. As shown in FIG. 5*c*, a portion of the sliding card 540 extends out from the closed clamshell, which allows for the user to pull the sliding card out from the clamshell 510.

Figure 6A:
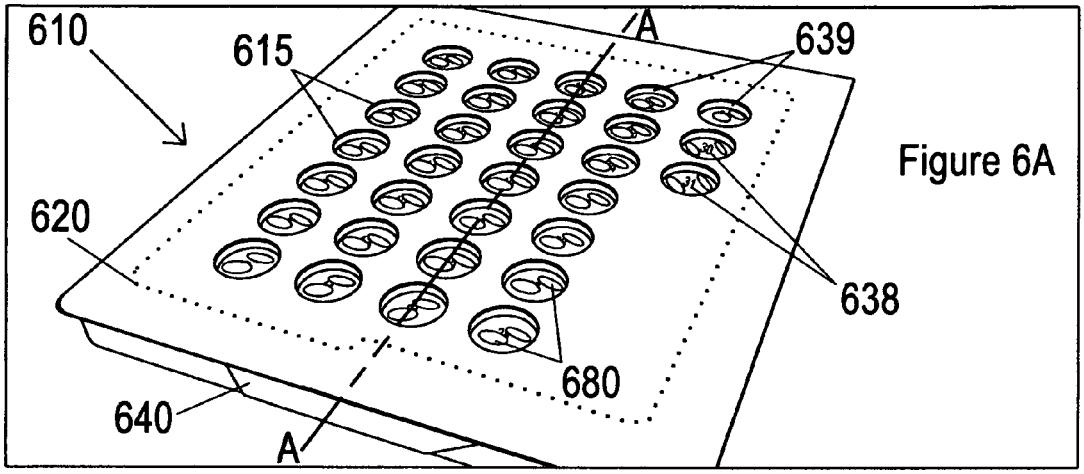
FIG. 6*a* illustrates perspective and cross-sectional views of the allocation of pills into the pill chambers of the pill tray in accordance with the present invention.
Figure 6B:
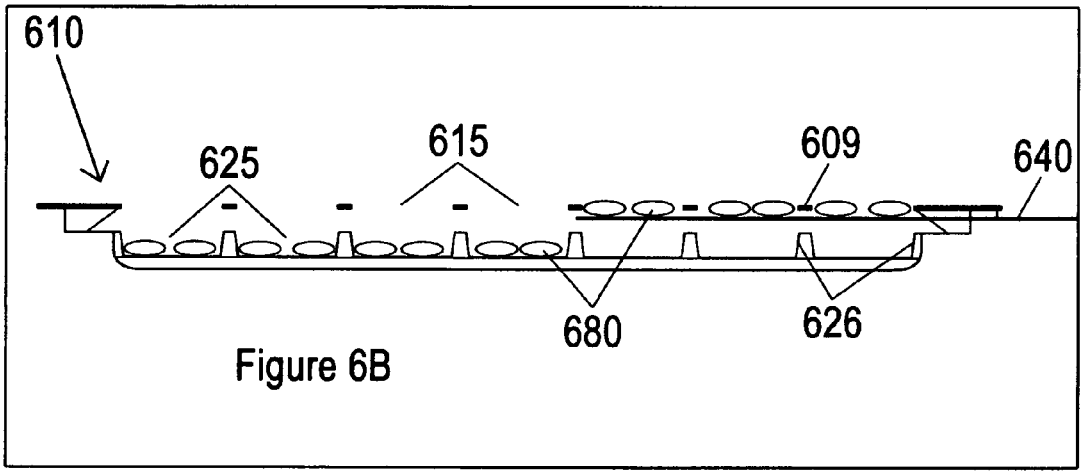
FIG. 6*b* illustrates perspective and cross-sectional views of the allocation of pills into the pill chambers of the pill tray in accordance with the present invention.
Figure 6C:
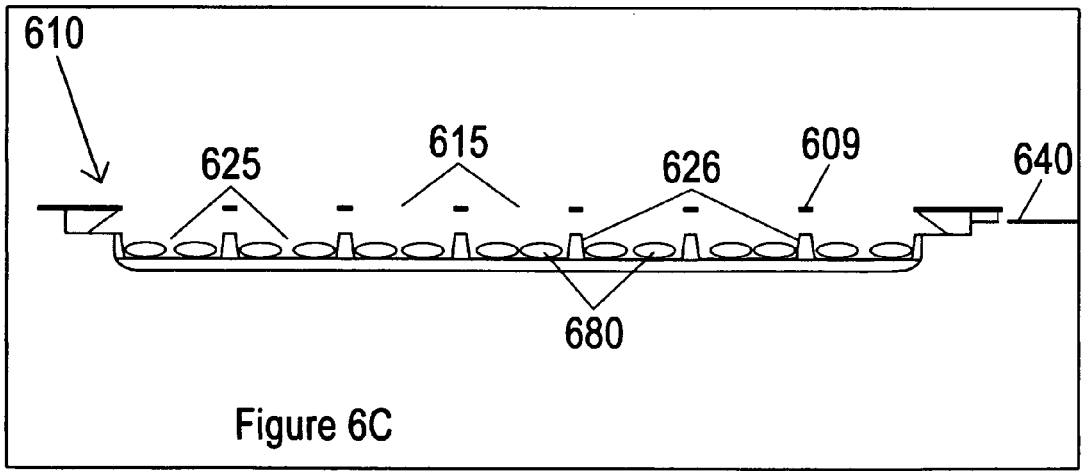
FIG. 6*c* illustrates perspective and cross-sectional views of the allocation of pills into the pill chambers of the pill tray in accordance with the present invention.

FIGS. 6*a-c* illustrate perspective and cross-sectional views of the allocation of pills into the pill chambers of the pill tray in accordance with the present invention. Referring to FIG. 6*a*, the clamshell pill container 610 houses the pill tray 620 and sliding card 640. The sliding card rests on top of the pill tray 620 and immediately beneath the top portion 609 of the clamshell container 610. Elements 609 represent the cross sections of the top portion of the clamshell, i.e. the material between the pill holes as intersected by line "A" in FIG. 6*a*. The pill tray rests on the bottom portion of clamshell container 610 as shown in FIGS. 6*b-c*. The sliding card 640 includes markings that correspond to the pill chambers directly below them. As shown, the user allocates pills 680 into the space formed by the pill holes 615 of top portion 609 and the surface of the sliding card 640, referred to as shallow chambers 639. For example, whatever pills the user wants to place within pill chamber number "15", they will place onto the area marked "15" on the sliding card 640.

FIG. 6*b* shows a cross-sectional view of the device through the line "A" shown in FIG. 6*a* wherein the sliding card 640 is pulled partially out of the clamshell container 610. As shown, pill holes 615 are positioned directly above the pill chambers 625 (which are defined by the pill chamber walls 626). Because the pills 680 are supported by the sliding card 640, as the sliding card 640 is pulled out, the pills fall into the pill chambers 625 below. As shown, the pills to the left of the sliding card 640 have fallen into the pill chambers 625, while the other pills remain on the sliding card 640 within the pill holes 615. FIG. 6*c* shows a cross-sectional view of the device through the line "A" shown in FIG. 6*a* with the sliding card 640 pulled completely out of the clamshell container 610. Thus, all the pills 680 that were allocated onto the surface of sliding card 640 (within pill holes 615) have fallen into the corresponding pill chambers 625. This process can be repeated by the user to add additional pills to some or all of the pill chambers as desired. This provides an organized and easy way for the user to create a pill intake schedule.

If a child or other individual wanted to take a pill from a chamber, they would need to break the foil seal, which would be readily evident, making tampering unlikely. One doing so would seek to minimize detection by taking all the contents of the chamber instead of leaving unwanted pills behind in the pill chambers in order to give the impression that the owner had consumed the contents. However, detection is still evident because the chambers are numerically marked (e.g. sequentially or calendar-based). Thus, detection of tampering is readily evident, which serves as a deterrent. This embodiment allows for user customization wherein the user can create their own array of sealed, pill-containing chambers. Although a foil seal has been described, other suitable materials such as paper could be utilized that allow for a user to conveniently push through the material to access the contents of the pill chamber.

Thus, as set forth above, the present invention provides a simple and effective means for storing, organizing, and dispensing prescription pills. Moreover, the invention provides an effective way for a prescription pill holder to keep track of pills and deter unwanted access. While there have been described herein what are considered to be preferred and exemplary embodiments of the present invention, other modifications of the invention shall be apparent to those skilled in the art from the teachings herein. It is noted that the embodiments disclosed are illustrative rather than limiting in nature and that a wide range of variations, modifications, changes, substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

What is claimed is:

1. A device for storing and organizing pills comprising:

a container having a top portion hingedly connected to a bottom portion, the top portion having an array of pill holes, wherein the top and bottom portions come into contact with each other when the container is in a closed position;

a pill tray containing an array of pill chambers that are accessed from a top surface of the pill tray, wherein the array of pill chambers align with the array of pill holes in the top portion of the container;

a pill tray seal having the same dimensions of the pill tray and comprised of a thin sheet of material having an adhesive film on a bottom portion, the adhesive film covered by a peel-away sticker, wherein upon removal of the peel-away sticker the pill tray seal can be pressed against the top surface of the pill tray to seal the pill tray chambers; and a sliding card configured to slide between the top surface of the pill tray and the top portion of the container, the sliding card having a top surface on which pills are placed;

wherein the container is configured to house the pill tray, pill tray seal, and sliding card.

2. The device of claim 1 wherein the pill tray seal is comprised of a foil material.

3. The device of claim 1 wherein the pill tray seal is comprised of a paper material.

4. The device of claim 1 wherein the pill tray is composed of a disposable material such as a thin polymer.

5. The device of claim 1 wherein the pill tray, is composed of a rigid polymeric material.

6. The device of claim 1 wherein the bottom portion of the container has a pair of opposing linear protrusions that run along opposing edges of the bottom portion, the pill tray configured to rest on the bottom portion of the container within the linear protrusions.

7. The device of claim 1 wherein the sliding card contains markings that correspond to the pill chambers of the pill tray.

8. The device of claim 1 wherein pills are held within a space defined by the pill holes of the top portion of the container and a top surface of the sliding card, the sliding card resting on top of the pill tray and beneath the top portion of the container such that removal of the sliding card causes the pills to fall into corresponding pill chambers below.

9. The device of claim 1 configured to allocate pills into the pill chambers by the following steps:

receiving pills within a space defined by the pill holes of the top portion of the container and a top surface of the sliding card, the sliding card resting on top of the pill tray and beneath the top portion of the container; and removal of the sliding card from the container to cause the pills to fall into the corresponding pill chambers below.

10. The device of claim 1 wherein the pill tray is composed of a disposable material such as a thin polymer.

11. The device of claim 1 wherein the pill tray is composed of a rigid polymeric material.

12. A method of storing and organizing pills in a pill container comprising:

receiving pills within a space defined by pill holes in a top surface of the container and a top surface of a sliding card, the sliding card resting on top of a pill tray having an array of pill chambers, wherein the array of pill chambers align with the array of pill holes in the top portion of the container;

removing the sliding card from the container to cause the pills to fall into the corresponding pill chambers below; and sealing the pill tray by applying a pill tray seal comprising a thin sheet of material having the same dimensions as the pill tray and an adhesive surface covered by a peel-away sticker, whereby upon removal of the peel-away sticker the adhesive surface is pressed against the top surface of the pill tray to seal the pills within the pill tray chambers.

13. The method of claim 12 wherein the pill tray is composed of a disposable material such as a thin polymer.

14. The method of claim 12 wherein the pill tray is composed of a rigid polymeric material.

* * * * *